US006007118A

United States Patent [19]

Arabia, Jr. et al.

[11] Patent Number: 6,007,118

[45] Date of Patent: Dec. 28, 1999

[54] VEHICLE DOOR LATCH

[75] Inventors: Frank Joseph Arabia, Jr., Macomb Township, Macomb County; Donald Michael Perkins, Rochester Hills, both of Mich.

[73] Assignee: General Motors Corporation, Detroit, Mich.

[21] Appl. No.: 09/138,272

[22] Filed: Aug. 21, 1998

[51] Int. Cl.[6] ..... E05C 3/06

[52] U.S. Cl. ..... 292/216; 292/DIG. 23; 292/DIG. 27; 292/DIG. 62

[58] Field of Search ..... 292/216, DIG. 23, 292/DIG. 27, 169.11, DIG. 62

[56] References Cited

U.S. PATENT DOCUMENTS

| | | | |
|---|---|---|---|
| 4,492,395 | 1/1985 | Yamada | 292/216 |
| 5,046,769 | 9/1991 | Rimbey et al. | 292/216 |
| 5,100,185 | 3/1992 | Menke et al. | 292/216 |
| 5,106,135 | 4/1992 | Menke et al. | 292/216 |
| 5,277,461 | 1/1994 | Dzurko et al. | 292/216 |
| 5,328,219 | 7/1994 | Konchan et al. | 292/216 |
| 5,738,394 | 4/1998 | Arabia, Jr. et al. | 292/216 |
| 5,762,383 | 6/1998 | Gomi | 292/216 |
| 5,802,894 | 9/1998 | Jahrsetz et al. | 70/264 |

*Primary Examiner*—Darnell M. Boucher
*Assistant Examiner*—Clifford B Vaterlaus
*Attorney, Agent, or Firm*—Kathryn A. Marra

[57] ABSTRACT

A vehicle door latch has a selectively engaged security lock that prevents a vehicle door from being unlatched by an inside door handle. The security lock overrides the door lock when the inside door handle is operated with the security lock engaged so that the vehicle door latch may be unlocked from inside the vehicle easily when the security lock is engaged.

13 Claims, 4 Drawing Sheets

VEHICLE DOOR LATCH

TECHNICAL FIELD

This invention relates generally to a vehicle door latch and more particularly to a vehicle door latch that has a selectively activated security lock that prevents a vehicle door from being unlatched by an inside door handle when activated.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well-known manner to latch the door when it is closed and to lock the door in the closed position or to unlock and unlatch the door so that the door can be opened manually. The door latch is operated remotely from inside the passenger compartment by two distinct operators—a sill button or electric switch that controls the locking function and a handle that controls the latching function. The door latch is also operated remotely from the exterior of the automobile by a handle or push button that controls the latching function. A second distinct exterior operator, such as a key lock cylinder, may also be provided to control the locking function, particularly in the case of a front vehicle door. Each operator is accessible outside the door structure and extends into the door structure where it is operatively connected to the door latch mechanism by a cable actuator assembly or linkage system located inside the door structure.

U.S. Pat. No. 5,277,461 granted to Thomas A. Dzurko et al on Jan. 11, 1997 for a vehicle door latch, which is hereby incorporated in this patent specification by reference, discloses a typical door latch. The door latch disclosed in the Dzurko '461 patent includes an inside latch operating lever that is pivotally mounted on a flange of a metal face plate and that is connected by a suitable linkage for rotation by an inside door handle (not shown). See column 4, lines 10–18 of the Dzurko '461 patent. The door latch also includes an inside lock operating lever that is pivotally mounted on the flange of the metal face plate near the inside latch operating lever. The inside lock operating lever is operated by an inside sill button or lock slide. See column 5, lines 46–58 and column 6, lines 8–15 of the Dzurko '461 patent. The door latch disclosed in the Dzurko '461 patent is released from the passenger compartment in two stages. First, the inside lock operating lever is rotated counterclockwise by an inside sill button or lock slide to unlock the door latch. Then, the inside latch operating lever 56 is rotated clockwise by an inside door handle to unlatch the door latch so that the vehicle door may be opened manually.

Door latches of the type disclosed in the Dzurko '461 patent have been used successfully by General Motors Corporation for many years.

Another vehicle door latch of General Motors Corporation is disclosed in U.S. Pat. No. 5,308,128 granted to Alfred L. Portelli and Rita M. Paulik on May 3, 1994 for a vehicle door latch that operates in a similar manner. The vehicle door latch disclosed in this patent, however, has a selectively activated security lock that prevents the door latch from being unlatched by an inside door handle or other inside operator. While this system is useful for many purposes, there are instances where it is desirable to allow passengers to unlock the door latch from inside the vehicle even though these passengers are not able to unlatch the door from inside the vehicle. While the vehicle door latch can often be unlocked by a sill button or an electric switch in the case of electric door locks, sill buttons are often difficult to operate by small children and an electric door lock may not be operable in case of a dead battery.

SUMMARY OF THE INVENTION

The object of this invention is to provide a vehicle door latch that has an inside latch operating assembly for unlatching the door latch from inside the vehicle, a lock for disabling the inside latch operating assembly, and a selectively activated security lock that not only disables the inside latch operating assembly but also operates the lock so that the door latch can be unlocked easily when the security lock is activated.

A feature of the vehicle door latch of the invention is that the vehicle door latch has an inside latch operating assembly for unlatching the door latch from inside the vehicle that automatically overrides the door lock when operated with the security lock activated.

Another feature of the vehicle door latch of the invention is that the vehicle door latch has a selectively activated security lock and an inside latch operating assembly that normally unlatches the door latch from inside the vehicle and that unlocks but does not unlatch the door latch when the security lock is activated.

Yet another feature of the vehicle door latch of the invention is that the vehicle door latch has a selectively activated security lock that disables an inside latch operating assembly when activated and an inside latch operating assembly that operates the door lock when the disabled lock operating assembly is operated.

These and other objects, features and advantages of the invention will become apparent from the description below, which is given by way of example with reference to the accompanying drawings.

DESCRIPTION OF THE PREFERRED EMBODIMENT

Figure 1:
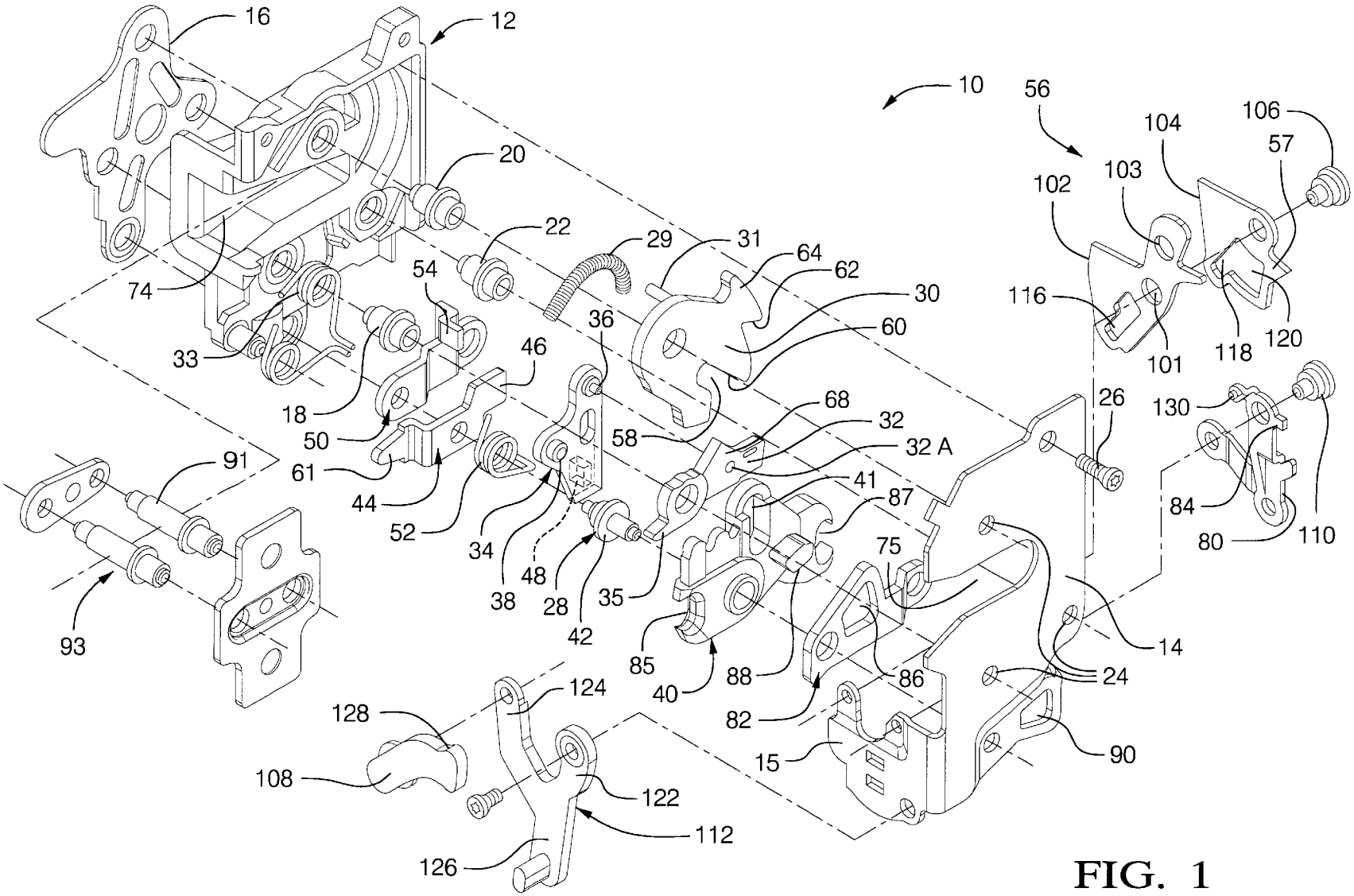
FIG. 1 is an exploded perspective view of a vehicle door latch that is equipped with a security lock in accordance with the invention.

Referring now to FIG. 1, the vehicle door latch 10 has a multi-piece enclosure that comprises plastic housing 12, metal faceplate 14 and metal back plate 16. The plastic housing 12 and the metal back plate 16 are held together by three flanged, internally threaded bushings 18, 20 and 22 that are inserted into three holes in the plastic housing 12, then through three aligned holes in the back plate 16 and then flanged over the back plate. The metal face plate 14 has three bolt holes 24 that are aligned with the bushings 18, 20 and 22 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened or headed over.

The Latch Mechanism

The latch mechanism of the vehicle door latch 10 comprises a fork bolt 30 and a cooperating detent 32 that are pivotally mounted on bushings 20 and 18, respectively, and located in a chamber of the plastic housing 12 behind the metal face plate 14. The fork bolt 30 is biased clockwise by a coil spring 29. Coil spring 29 is disposed in a curved slot in the plastic housing 12 behind the fork bolt 30, and it engages a depending pin 31 of the fork bolt 30 at one end. Detent 32 is biased counterclockwise into engagement with the fork bolt 30 by a coil spring 33 that surrounds the bushing 18 and that has one end engaging an ear 35 of the detent 32. Detent 32 engages shoulder 60 and holds the fork bolt lever 30 in a primary latched position against the bias of spring 29 as shown in FIG. 1. Detent 32 also can engage fork bolt 30 at shoulder 62 and hold it in an intermediate secondary latched position. Detent 32 engages fork bolt 30 at foot 64 in its unlatched position.

The latch mechanism further comprises an intermittent lever 34 for operating detent 32. Intermittent lever 34 is located in the chamber of the plastic housing 12 behind detent 32. It has two integral pivot pins 36 and 38. Pivot pin 36 is journalled in a hole 32*a* in detent 32 so that the detent 32 rotates clockwise from the latched position shown in FIG. 1 (and out of latched engagement with the fork bolt 30) to an unlatched position when the intermittent lever 34 is pulled down. The pivot pin 38 is disposed in a slot 41 of a locking lever 40 that pivots the intermittent lever 34 counterclockwise about pivot pin 36 from the unlock position shown in FIG. 1 to a lock position (not shown). The locking lever 40 is journalled on the stud 28 between flange 42 and faceplate 14. Briefly, the locking lever 40 is rotated clockwise to lock the door latch 10 or counterclockwise to unlock the door latch. Clockwise rotation from the unlocked position shown in FIG. 1 pivots intermittent lever 34 counterclockwise about pivot pin 36 to a position where it is uncoupled from and out of the path of travel of transfer lever 44 described below. A more complete description of the locking lever 40 and locking mechanism is given after the latch mechanism is described.

The latch mechanism further comprises a transfer lever 44 that is journalled on a reduced diameter portion of the stud 28 spaced rearwardly of the flange 42. The transfer lever 44 has an ear 46 at one end that is engageable with an integral, rearwardly projecting tab 48 of the intermittent lever 34 so that the intermittent lever 34 is pulled down when the transfer lever 44 is rotated clockwise as viewed in FIG. 1.

The latch mechanism further comprises an outside latch operating lever 50 and a coil return spring 52. The outside latch operating lever 50 is also journalled on the reduced diameter portion of the stud 28 behind transfer lever 44. It has a bent tab 54 that engages ear 46 of transfer lever 44 so that outside latch operating lever 50 rotates transfer lever 44 clockwise when it is rotated clockwise on stud 28. Outside latch operating lever 50 is connected by suitable linkage for rotation by an outside door handle (not shown).

The coil return spring 52 is disposed around the stud 28 and located between the flange 42 and the transfer lever 44. One end of the coil spring 52 engages the bottom of transfer lever 44 and the other end engages the bottom of the plastic housing 12 above transfer lever 44 so that transfer lever 44 and outside operating lever 50 are biased counterclockwise to a rest position where tab 54 engages a stop at the bottom of plastic housing 12.

The latch mechanism further comprises an inside latch-operating assembly 56 that is pivotally mounted on a flange 15 of the metal faceplate 14. The inside latch operating assembly 56 has a tab 57 that engages a second ear 61 of transfer lever 44 so that the inside latch operating assembly 56 also rotates the transfer lever 44 clockwise when it is rotated counterclockwise. The inside latch operating assembly 56 is connected to a suitable cable actuator assembly or linkage system (not shown) for rotation by an inside door handle or other operator (not shown). The inside latch operating assembly 56 can be disabled by a security lock as described and explained in detail below.

Fork bolt 30 has a conventional slot or throat 58 for receiving and retaining striker pin 91 of a striker assembly 93 that is attached to the vehicle door pillar to latch the vehicle door in the closed position (not shown). Fork bolt 30 also includes a primary latch shoulder 60, an intermediate secondary latch shoulder 62 and a radially projecting foot 64. Fork bolt 30 preferably has a plastic coating that covers a surface of the slot 58 that is engaged by striker pin 91 for energy absorption and quiet operation when the vehicle door is slammed shut.

Detent 32 has a sector shaped catch 68 that engages the radially projecting foot 64 when the fork bolt 30 is in the unlatched position (not shown). The sector shaped catch 68 positively engages the primary and latch shoulders 60 and 62 to hold the fork bolt 30 in either the primary or the intermediate secondary latched positions shown in FIG. 1 and not shown, respectively. Detent 32 also preferably includes a plastic coating that has an integral bumper. The bumper engages the bushing 22 to stop counterclockwise pivoting of the detent lever 32 under the bias of spring 33. This bumper also absorbs energy and quiets operation when the door is slammed shut.

The conventional latch mechanism described above operates as follows. When the door latch 10 is in an unlatched and unlocked condition, fork bolt 30 is poised to receive strike pin 91 that projects into aligned fishmouth slots 74 and 75 of plastic housing 12 and metal face plate 14 when the door is shut. The entering strike pin 91 engages the back of the throat 58 and rotates fork bolt 30 counterclockwise against the bias of spring 29 until fork bolt 30 is rotated to the primary latch position shown in FIG. 1 where fork bolt 30 captures the striker pin 91 in the throat 58. Fork bolt 30 is held in the primary latch position by catch 68 of detent 32 engaging the primary latch shoulder 60 of fork bolt 30.

Catch 68 rides along the periphery of the fork bolt 30 under the bias of spring 33 as fork bolt 30 rotates counterclockwise from the unlatched position to the primary latch position shown in FIG. 1. During this travel, catch 68 rides under the foot 64 into engagement with the intermediate secondary latch shoulder 62 and then into engagement with primary latch shoulder 60. Engagement of catch 68 with the intermediate secondary latching shoulder 62 is sufficient to hold the vehicle door closed in the event that the vehicle door is not shut with sufficient force so that catch 68 engages primary latch shoulder 60.

The vehicle door latch 10 is not locked and the inside latch operating assembly 56 is not disabled by the security lock so that the vehicle door can be opened simply by operating either an inside or outside door handle or the like to rotate the transfer lever 44 clockwise and the ear 46 down as viewed in FIG. 1. Ear 46 engages projection 48 of intermittent lever 34 and pulls the intermittent lever 34 down from the primary latch position shown in FIG. 1. As the intermittent lever 34 is pulled down, it rotates detent 32 clockwise against the bias of spring 33 from the primary latch position shown in FIG. 1. Fork bolt 30 is then free to rotate counterclockwise under the bias of spring 29 from the primary latch position shown in FIG. 1 to an unlatched position as the striker pin 91 is pulled out of the aligned fishmouth slots 74 and 75 when the vehicle door is opened.

The Lock Mechanism

The lock mechanism is actuated by rotating the locking lever 40 that is journalled on stud 28 between flange 42 and faceplate 14 clockwise. Clockwise rotation of the locking lever 40 rotates intermittent lever 34 counterclockwise about the pivot pin 36 that is journalled in the detent 32 due to the engagement of the second pivot pin 38 of the intermittent lever 34 in slot 41 of locking lever 40. Intermittent lever 34 is thus rotated counterclockwise from the unlocked position shown in FIG. 1 to an locked position where projection 48 is repositioned out from under ear 46 of transfer lever 44. Consequently, when the door handles or the like are operated so as to rotate the transfer lever 44 clockwise to the unlatching position, ear 46 simply bypasses projection 48 without transferring any motion to intermittent lever 34. Consequently, intermittent lever 34 is not pulled down to rotate detent 32 to the unlatch position. In other words, the transfer lever 44 simply freewheels so that operation of the door handles or their equivalent is not effective.

The lock mechanism further comprises an inside lock operating lever 80 and an optional outside lock operating lever 82. Inside lock operating lever 80 is pivotally mounted on flange 15 of the metal face plate 14 at a location spaced from the pivot for the inside latch operating assembly 56. Inside lock operating lever 80 has an ear 84 that fits in a slot 85 at one end of locking lever 40. Outside operating lever 82 is pivotally mounted on stud 28 in front of locking lever 40. Locking lever 40 has a protuberance 88 that projects through a sector shaped hole 86 in outside lock operating lever 82 and then through a smaller sector shaped hole 90 in faceplate 14.

Protuberance 88 and sector shaped hole 90 limit rotation of locking lever 40 from an unlocked position shown in FIG. 1 where protuberance 88 engages the upper edge of hole 90 to a locked position (not shown) where protuberance 88 engages the lower edge of hole 90.

Locking lever 40 is rotated clockwise from the unlocked position shown in FIG. 1 to the locked position by rotating inside lock operating lever 80 counterclockwise as viewed in FIG. 1. Inside lock operating lever 80 is actuated by a suitable cable actuator assembly or linkage system (not shown) for rotation by an inside sill button or other operator (not shown). The inside lock operating lever 80 is also operated in the unlock direction by the inside latch operating assembly 56 when the security lock is engaged as explained below.

Locking lever 40 can also be rotated clockwise from the unlocked position shown in FIG. 1 to the locked position by rotating outside lock operating lever 82 clockwise. Outside lock operating lever 82 is optional and normally used only in front vehicle doors where the lock operating lever 82 is generally actuated by a key lock cylinder through a suitable linkage (not shown). Locking lever 40 also has a slot 87 for operating the locking lever 40 by a linear electric or vacuum motor.

The Security Lock

Vehicle door latch 10 also includes a security lock 100 (FIG. 2) for disabling the inside latch operating assembly 56 so that vehicle door latch 10 cannot be unlatched by the inside door handle or other operator inside the vehicle. However, when the inside latch operating assembly 56 is disabled by the security lock, the inside latch operating assembly 56 unlocks the vehicle door latch 10 so that the vehicle door can be opened by outside latch operating lever 50 via an outside door handle or other outside operator.

The inside latch operating assembly 56 is part of security lock 100 and for this purpose comprises an input member 102 and an output member 104. Input member 102 has a central hole 101 by which it is rotatably mounted on support flange 15 of face plate 14 by pin 106 for rotation from a latch position shown in FIGS. 1, 2, 4 and 5 to an unlatch position shown in FIGS. 3 and 6. Output member 104 is also rotatably mounted on the flange 15 of face plate 14 by pin 106 for rotation from a latch position shown in FIGS. 1, 2, 4, 5 and 6 to an unlatch position shown in FIG. 3. However, rotation of output member 104 depends upon an override cam coupler 108 as explained below, and thus the potential of output member 104 for unlatching vehicle door latch 10 when input member 102 of inside latch operating assembly 56 is in the unlatch position may not be realized as demonstrated by FIG. 6, which is discussed in detail below.

Input member 102 of inside latch operating assembly 56 has a second hole 103 for connection to a suitable cable assembly or linkage system (not shown) for actuation by an inside door handle or other operator inside a vehicle.

As indicated above, vehicle door latch 10 includes an inside lock operating lever 80 that is mounted on support flange 15 of face plate 14 by pin 110 for rotation between an unlock position and a lock position where inside latch operating assembly 56 is disabled from unlatching vehicle door latch 10. The lock position of the inside lock operating lever 80 is shown in FIGS. 2, 3, 4 and 5. The unlock position of the inside lock operating lever 80 is shown in FIGS. 1 and 6.

Security lock 100 includes a security lever 112 for moving override cam coupler 108. Security lever 112 is movably mounted on input member 102 and moves between a coupling position and a decoupling position with respect to the output member 104 of inside latch operating assembly 56. For this purpose, override cam coupler 108 has a slide 114 that is disposed in a straight, narrow, close ended slot 116 of input member 102 and an angular slot 118 of output member 104 that has a wide arcuate portion 120 at one end as best shown in FIGS. 2 and 5.

Figure 2:
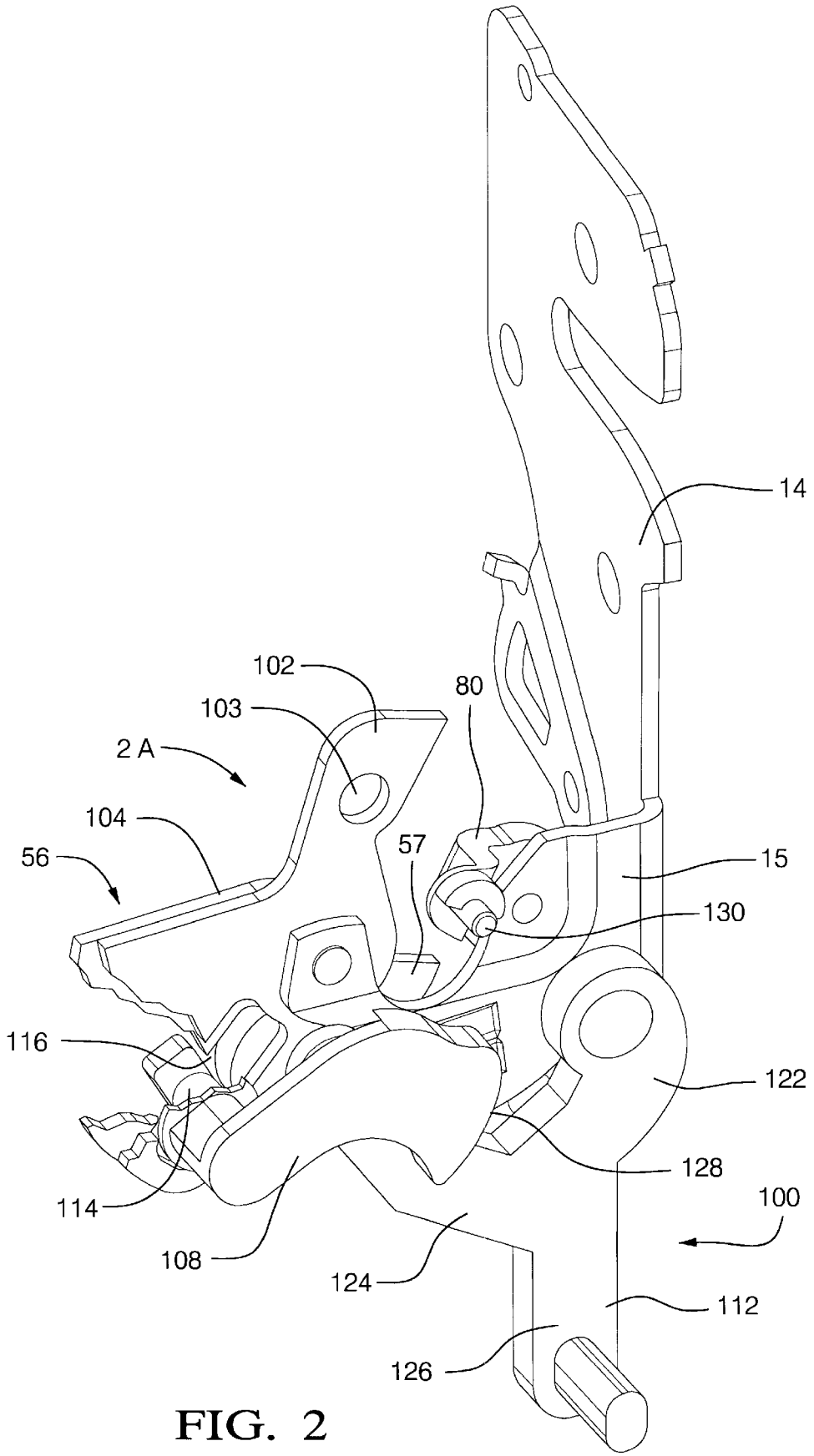
FIG. 2 is an enlarged perspective view of the security lock portion of the vehicle door latch of FIG. 1 showing the parts in position when the vehicle door latch is latched and locked with the security lock disengaged.
Figure 5:
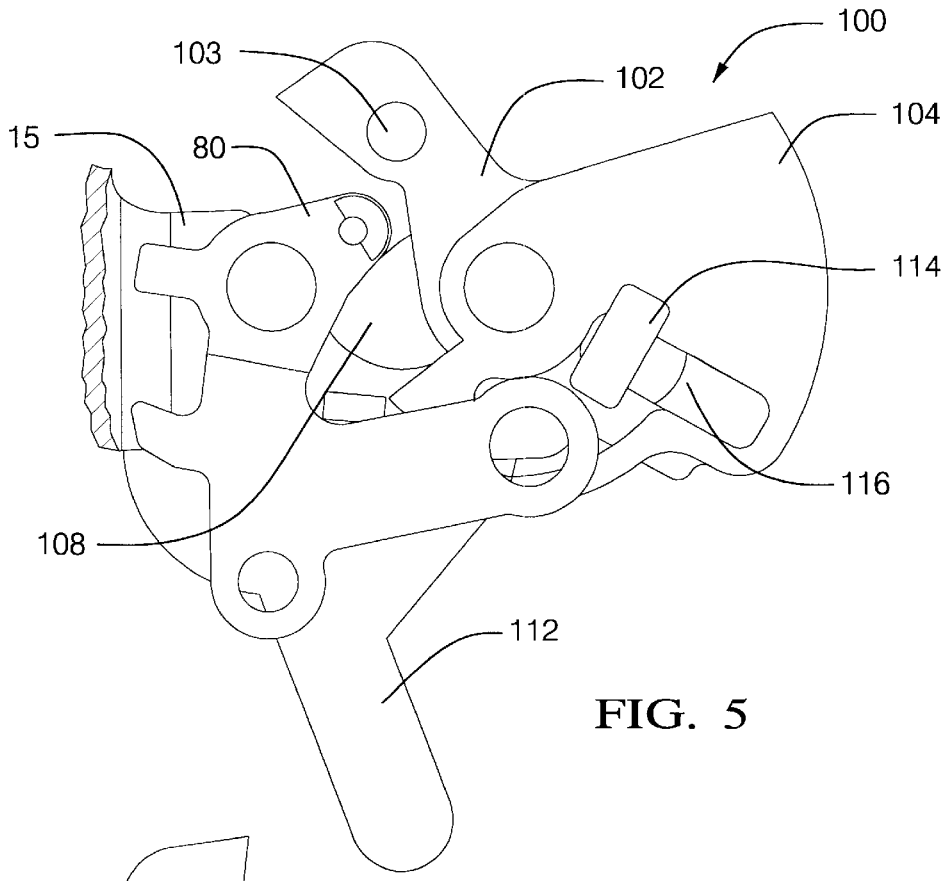
FIG. 5 is a back side fragmentary view of FIG. 4.
Figure 6:
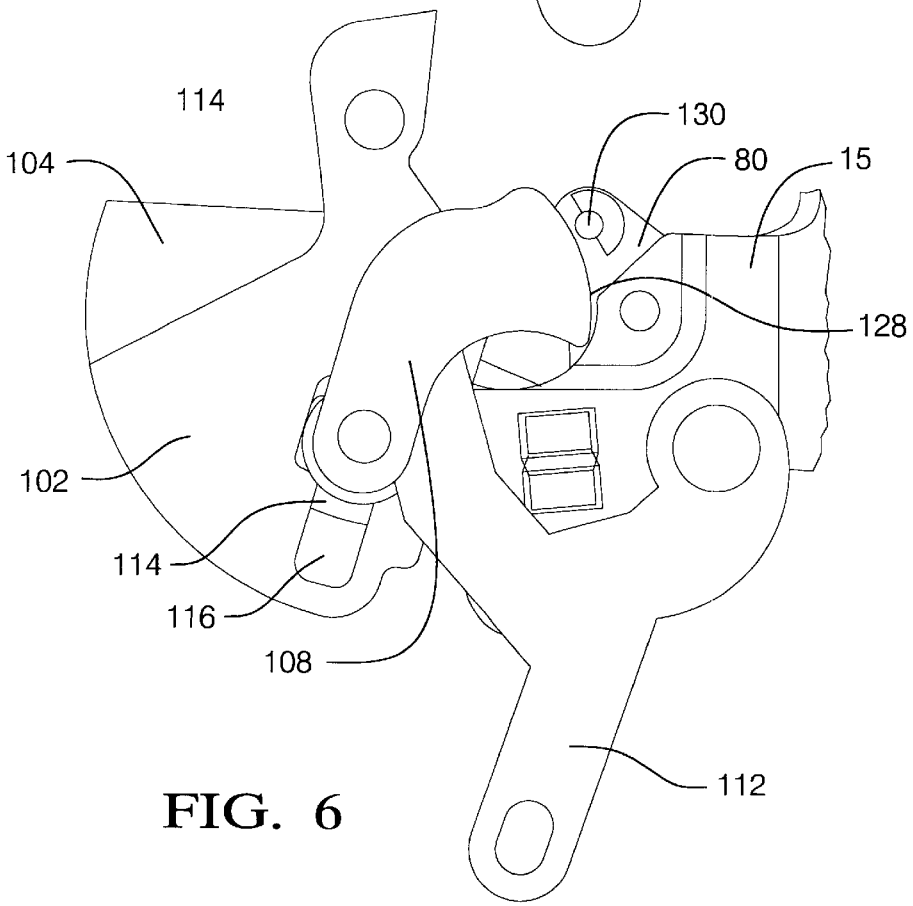
FIG. 6 is an enlarged fragmentary side view showing the security lock parts in position when the vehicle door latch is unlatched with the security lock engaged.

Slide 114 moves from a coupling position best shown in FIG. 2 where input member 102 drives output member 104 from the latch position to the unlatch position via slide 114 and the narrow lower end of slot 118, to a decoupling position best shown in FIG. 5 where input member 102 does not drive output member 104 to the unlatch position due to the alignment of slide 114 with the wide arcuate portion 120 at the upper end of slot 118 that allows input member 102 to rotate relative to output member 104.

Security lever 112 is Y-shaped with one branch end 122 pivotally mounted on support flange 15 of face plate 14 and the other branch end 124 pivotally secured to override cam coupler 108 for moving override cam coupler 108 back and forth between the coupling position (FIGS. 2 and 3) and the decoupling position (FIGS. 4, 5 and 6) when stem 126 is moved. Override cam coupler 108 includes a cam surface 128 that is engageable with a drive lug 130 of the lock operating lever 80.

Figure 3:
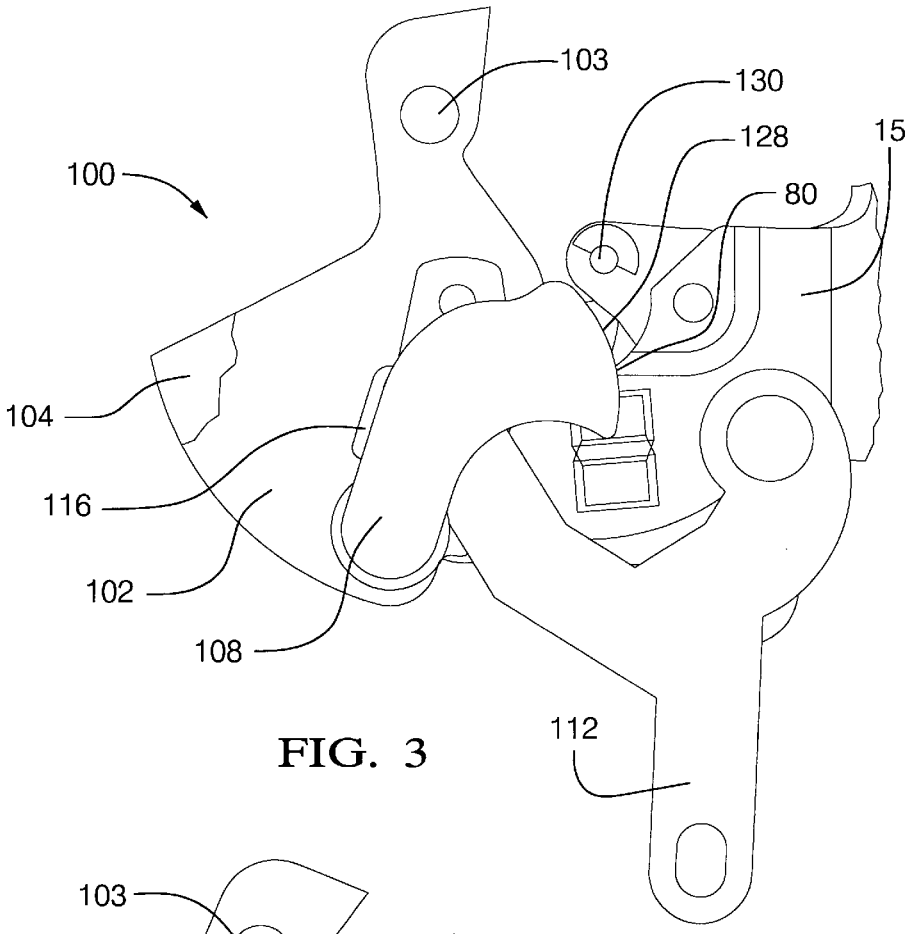
FIG. 3 is an enlarged fragmentary side view showing the security lock parts in position when the vehicle door latch is locked and unlatched with the security lock disengaged.

Security lock 100 operates as follows. When security lock 100 is disengaged as shown in FIGS. 2 and 3, input and output members 102 and 104 of inside latch operating assembly 56 are coupled together for concurrent movement and vehicle door latch 10 operates in a conventional manner. More specifically, when the vehicle door latch 10 is unlocked as shown in FIG. 1 and the security lock is disengaged as shown in FIGS. 2 and 3, output member 104 is rotated from the latch position (FIG. 2) to the unlatch position (FIG. 3) by input member 102 so that tab 57 of output member 104 engages ear 61 and rotates transfer lever 44 and outside operating lever 50 clockwise as viewed in FIG. 1. Transfer lever 44 and outside operating lever 50 pull intermittent lever 34 down rotating detent 32 out of engagement with the fork bolt 30. This releases fork bolt 30 so that the vehicle door can be opened manually. However, when vehicle door latch 10 is locked as shown in FIGS. 2 and 3, vehicle door latch 10 remains latched because transfer lever 44 and the outside operating lever 50 by pass projection 48 of intermittent lever 34.

In both of the above instances, cam surface 128 of override cam coupler 108 bypasses drive lug 130 of the lock operating lever 80 so the locking function of the vehicle door latch 10 is also not effected when security lock 100 is disengaged and the coupled inside latch operating assembly 56 is rotated from the latch position shown in FIG. 2 to the unlatch position shown in FIG. 3.

The normal operation of vehicle door latch 10 described above is modified by engaging the security lock 100. Security lock 100 is engaged by rotating the security lever 112 clockwise from the disengaged position shown in FIGS. 1, 2 and 3 to the engaged position shown in FIGS. 4, 5 and 6. When security lever 112 is moved to the engaged position shown in FIGS. 4, 5 and 6, override cam coupler 108 is shifted forward toward face plate 14 and underneath lock operating lever 80. This also moves slide 114 to the decoupling position as shown in FIG. 5. Thus, the shift of the override cam coupler 108 does two things. First, output member 104 is decoupled from input member 102 so that the inside latch operating assembly 56 does not operate the latch mechanism of the vehicle door latch 10, i.e., output member 104 does not move with input member 102 so that transfer lever 44 and outside latch operating lever 50 are not rotated. Consequently, vehicle door latch 10 cannot be unlatched when the security lock 100 is engaged. However, when security lock 100 is engaged, override cam coupler 108 is extended and cam surface 128 has a longer sweep. Hence, when input member 102 of inside latching assembly 56 is rotated from the latch position shown in FIGS. 4 and 5 to the unlatch position shown in FIG. 6, cam surface 128 engages drive lug 130 of the lock operating lever 80 and moves lock operating lever 80 from the lock position shown in FIGS. 4 and 5 to the unlock position shown in FIG. 6. Thus, the inside door handle or other operator inside the vehicle for unlatching vehicle door latch 10 unlocks vehicle door latch 10 when security lock 100 is engaged.

Figure 4:
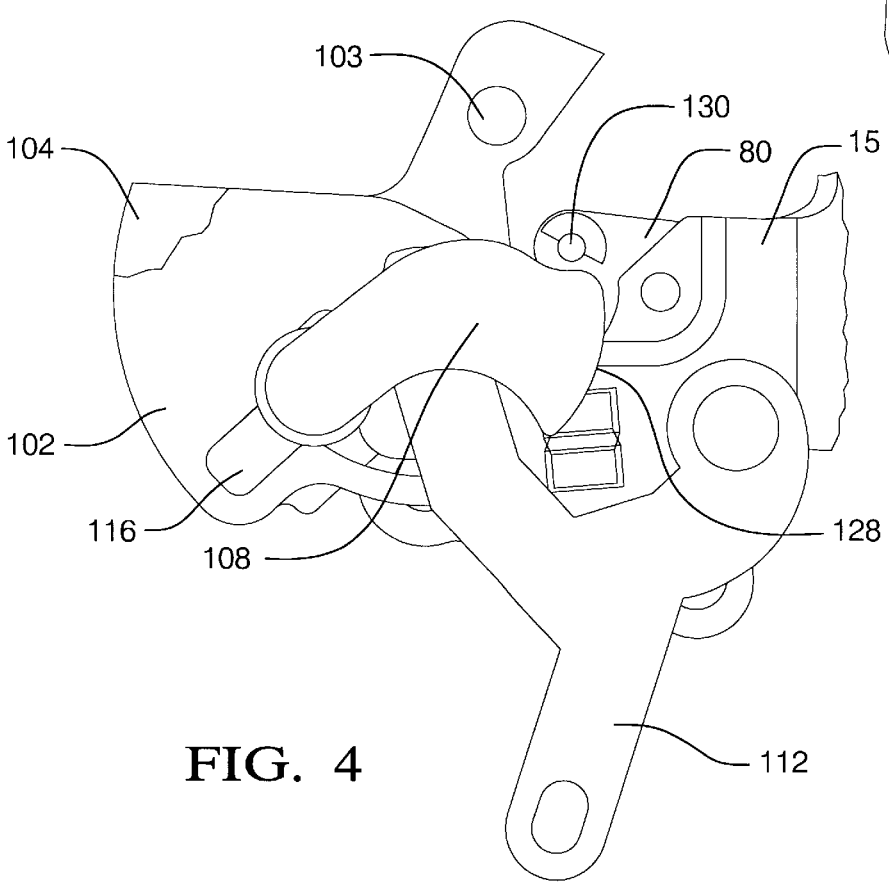
FIG. 4 is an enlarged fragmentary side view showing the security lock parts in position when the vehicle door latch is latched and locked with the security lock engaged.

In the event that lock operating lever 80 is already in the unlock position shown in FIG. 6 when input member 102 and override cam coupler 108 are moved from the latch position shown in FIGS. 4 and 5 to the unlatch position shown in FIG. 6, cam surface 128 merely engages drive lug 130 of lock operating lever 80 at or near the end of its stroke.

While override cam coupler 108 is preferably of one-piece construction as shown in the drawings for minimizing the number of moving parts in the vehicle door latch, the override cam coupler can be fabricated in two pieces and even replaced by separate members that function in a coordinated way. In other words, many modifications and variations of the present invention in light of the above teachings may be made. It is, therefore, to be understood that, within the scope of the appended claims, the invention may be practiced otherwise than as specifically described.

We claim:

1. A vehicle door latch having a security lock comprising:

a support rotatably mounting an inside latch operating assembly for rotation from a latch position to an unlatch position, the inside latch operating assembly having an input member adapted for actuation by an operator inside a vehicle and an output member that has a potential for unlatching the door latch when the inside latch operating member is in the unlatch position, an inside lock operating member mounted on the support for rotation between an unlock position and a lock position where the inside latch operating assembly is disabled from unlatching the door latch, a coupler that moves between a coupling position and a decoupling position with respect to the input member of the inside latch operating assembly, the coupler coupling the input and output members of the inside latch operating assembly when the coupler is in the coupling position, the coupler decoupling the input member from the output member of the inside latch operating assembly when the coupler is in the decoupling position and driving the inside lock operating member from the lock position to the unlock position when the inside latch operating assembly is moved from the latch position to the unlatch position with the input member decoupled from the output member, and a security member for moving the coupler from the coupling position to the decoupling position and vice-versa.

2. The vehicle door latch according to claim 1 wherein the coupler bypasses the inside lock operating lever when the inside latch operating assembly is moved from the latch position to the unlatch position with the input and output members of the inside latch operating assembly coupled together.

3. The vehicle door latch according to claim 1 wherein the coupler has a cam that engages a follower of the inside lock operating member to drive the inside lock operating member from the lock position to the unlock position.

4. The vehicle door latch according to claim 1 wherein the coupler has a slide that moves in a slot of the input member and a slot of the output member.

5. The vehicle door latch according to claim 4 wherein the slot of the input member has a radial portion and the slot of the output member has a radial portion and a circumferential portion and wherein the slide moves in the circumferential portion in the decoupling position.

6. A vehicle door latch having a latching mechanism that is operated by an inside latch operator and an outside latch operator, a locking mechanism that is operated by an inside operator and an outside lock operator to disable the inside latch operator and the outside latch operator and a security lock that disables the inside latch operator, the security lock comprising:

the inside latch operator being an assembly having an input member, an output member and a coupler, the input member being adapted for operation from inside a vehicle, the output member being operatively connected to the latching mechanism for unlatching the vehicle door latch, the coupler having a slide disposed in respective slots of the input and the output members for movement between a disengaged position coupling the input and the output members for simultaneous movement and an engaged position permitting relative movement between the input and the output members, and the coupler being juxtaposed the inside lock operator in the engaged position and having a cam that engages a follower of the inside lock operator and drives the inside lock operator to an unlocked position when the input member is moved to an unlatching position whereby the vehicle door latch may be unlocked from inside the vehicle when the security lock is engaged.

7. The vehicle door latch as defined in claim 6 wherein the input member and the output member are pivotally mounted on a support, the slot of the output member has a radial portion and a circumferential portion, and the slide of the coupler is disposed in the circumferential portion of the slot of the output member when the security lock is engaged.

8. The vehicle door latch as defined in claim 7 wherein the cam has a sweep when the input member is pivoted with the security lock disengaged and a greater sweep when the input member is pivoted with the security lock engaged.

9. The vehicle door latch as defined in claim 8 further including a security member for moving the coupler back and forth between the engaged and the disengaged positions, the security member being pivotally mounted on the support and pivotally connected to the coupler.

10. The vehicle door latch as defined in claim 9 wherein the slide is at one end of the coupler, the cam is at an opposite end of the coupler and the security member is pivotally connected to the coupler between the ends.

11. The vehicle door latch as defined in claim 10 wherein the security member is a Y-shaped lever having one branch end pivotally mounted on the support and another branch end pivotally connected to the coupler.

12. A vehicle door latch having a latching mechanism that is operated by an inside latch operator and an outside latch operator, a locking mechanism that is operated by an inside operator and an outside lock operator to disable the inside latch operator and the outside latch operator and a security lock that disables the inside latch operator, the security lock comprising:

the inside latch operator having an input member and output member that are pivotally mounted on a support, the input member being adapted for operation from inside a vehicle, the output member being operatively connected to the latching mechanism for unlatching the vehicle door latch, a coupler having a slide at one end that is disposed in respective slots of the input and the output members for movement between a disengaged position coupling the members for simultaneous movement and an engaged position where the slide is disposed in a circumferential portion of one of the slots permitting relative movement between the input and the output members, the coupler being juxtaposed the inside lock operator in the engaged position and having a cam at an opposite end, the cam having a sweep when the input member is pivoted with the security lock disengaged and a greater sweep when the input member is pivoted with the security lock engaged so that the cam engages a follower of the inside lock operator and drives the inside lock operator to an unlocked position when the input member is moved to an unlatching position whereby the vehicle door latch may be unlocked from inside the vehicle when the security lock is engaged.

13. The vehicle door lock as defined in claim 12 further including a Y-shaped security member for moving the coupler back and forth between the engaged and the disengaged positions, the security member having one branch end pivotally mounted on the support and another branch end pivotally connected to the coupler between the ends of the coupler.

* * * * *